United States Patent [19]

Tervamaki

[11] Patent Number: 5,002,737

[45] Date of Patent: Mar. 26, 1991

[54] ELECTRICALLY OPERATED PIPETTE

[75] Inventor: Jukka Tervamaki, Helsinki, Finland

[73] Assignee: Labsystems Oy, Helsinki, Finland

[21] Appl. No.: 271,724

[22] Filed: Nov. 15, 1988

Related U.S. Application Data

[63] Continuation-in-part of Ser. No. 34,559, Mar. 5, 1987, abandoned.

[30] Foreign Application Priority Data

Aug. 7, 1985 [FI] Finland ..... 852704

[51] Int. Cl.[5] ..... B01L 3/02

[52] U.S. Cl. ..... 422/100; 73/864.13; 73/864.18; 222/43; 222/63; 222/386; 222/390

[58] Field of Search ..... 422/99, 100, 103; 73/864.13, 864.18; 222/41, 43, 63, 386, 390

[56] References Cited

U.S. PATENT DOCUMENTS

| | | | |
|---|---|---|---|
| 3,143,393 | 8/1964 | De Seguin Des Hons | 422/65 |
| 3,175,734 | 3/1965 | Heiss | 422/100 |
| 3,615,240 | 10/1971 | Sanz | 422/100 |
| 3,915,651 | 10/1973 | Nishi | 422/100 |
| 3,963,349 | 6/1976 | Albright et al. | 422/64 |
| 4,567,780 | 2/1986 | Opperlander et al. | 422/100 |

*Primary Examiner*—Robert J. Warden
*Assistant Examiner*—Timothy M. McMahon
*Attorney, Agent, or Firm*—Hopgood, Calimafde, Kalil, Blaustein & Judlowe

[57] ABSTRACT

The invention relates to an electrically operable pipette comprising a body member with upper and lower portions and a removable flanged cylinder assembly coupled to the lower portion of the body member via its flange. The cylinder assembly has confined in it, a piston which is vertically displaced by a motor confined in the body member, an adjustable limiter being provided for varying the stroke length of the piston and hence the volume of liquid displaced.

12 Claims, 5 Drawing Sheets

ELECTRICALLY OPERATED PIPETTE

This application is a continuation-in-part of Application Ser. No. 034,559, filed Mar. 5, 1987, now abandoned.

The present invention is concerned with an electrically operated pipette comprising a body, a cylinder in the body, as well as a piston displaceable by the force of an electric motor so as to suck liquid into the cylinder and to effect removal of the liquid out of the cylinder.

In prior art some electrically operated pipettes are known. However, such pipettes do not provide means for adjusting the volume.

THE INVENTION

The object of the present invention is to provide an electrically operated pipette in which the volume is capable of being adjusted.

The pipette now invented has an electric motor rotatable in either direction, which motor is adapted to rotate a cogwheel resting against a toothed rack provided on the piston rod of the pipette. In this way, it is possible to move the piston inward to suck liquid into the pipette cylinder, and outward to discharge liquid out of the cylinder.

The movement of the piston is limited by an upper limiter and a lower limiter, whereby it is possible to adjust the location of one (or both) of the said limiters in the direction of movement of the piston. In this way, it is possible to adjust the quantity of liquid for dosage. Preferably only the location of the upper limiter is adjustable.

The location of the limiter is best adjustable by means of a screw-nut joint, whereby, for example, the limiter is connected with a screw oriented in the direction of movement of the piston, around which said screw a revolving nut is fitted which remains stationary relative to the body in the direction of movement of the piston.

The volume adjustment is connected with a volume display. This can be provided, e.g., by means of mechanical display means comprising numeral rings or equivalent. A turnable volume adjustment is best associated with an electronic volume detector, to whose shaft the adjustment movement is transmitted. The movement of the volume detector is converted by means of an electronic card, e.g., to a liquid crystal display.

The invention, its objectives, and some preferred embodiments will be described in further detail in the following description and in the related drawings.

DETAILS OF THE INVENTION

Figure 1:
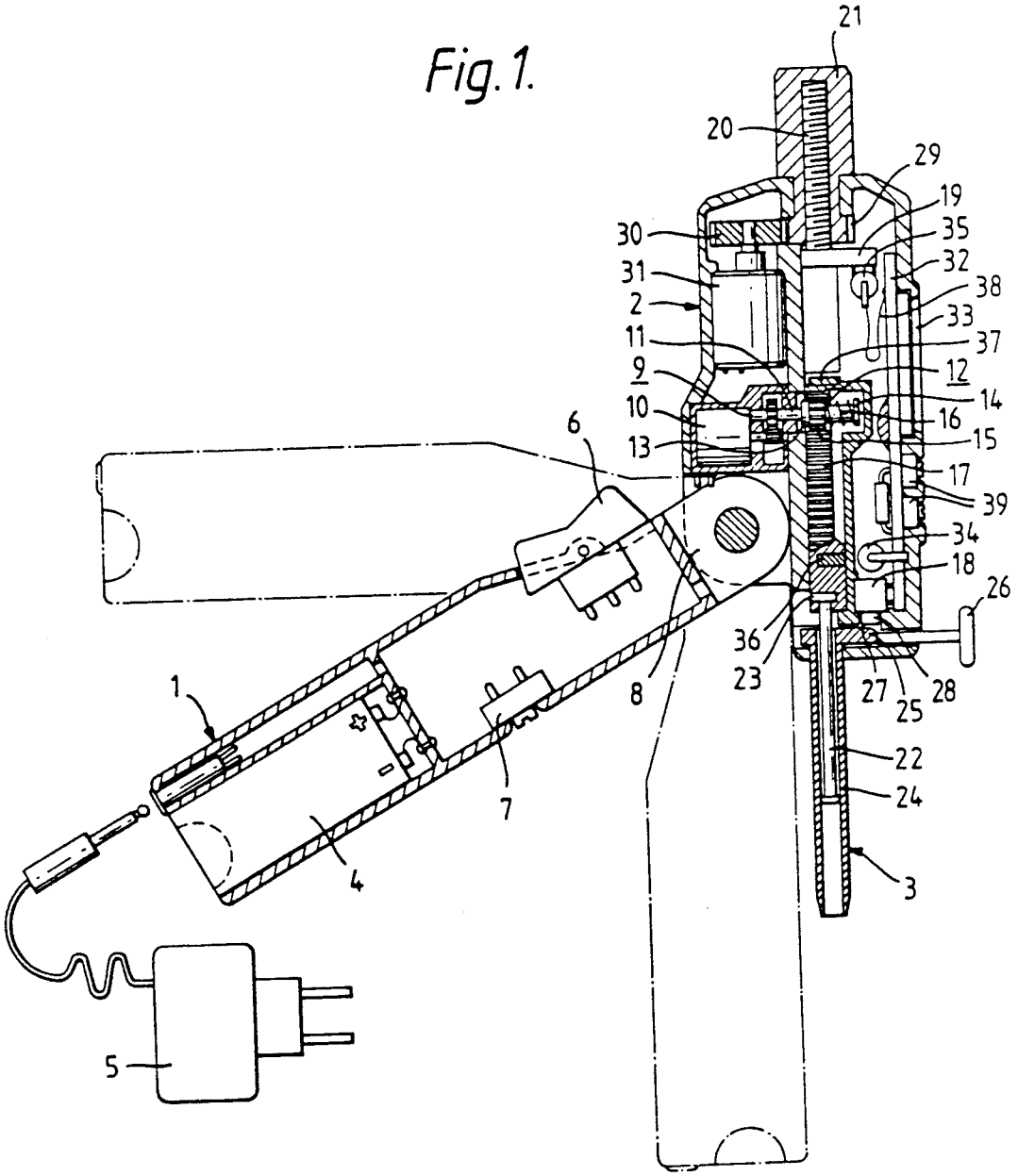
FIG. 1 is a sectional side view of a pipette in accordance with the invention; in the figure the recharging device can also be seen.

The main parts of the pipette in accordance with the invention are the handle 1, the frame or body member 2, and the cylinder part 3, the body member having upper and lower portions.

The voltage source 4 consists of an accumulator or a battery, which can be inserted straight into a housing provided at the end of the handle. If an accumulator is used, it can be recharged by means of a recharging device 5. For recharging, the accumulator may also be removed out of the handle.

The handle is provided with an operating switch 6 and with a speed adjustment switch 7 cooperably associated with said body member 2. The speed adjustment may be continuous or, e.g., have two steps.

The handle is attached to the body member by means of a vertically pivotable articulated joint 8. Thus, the operator may choose the handle position most appropriate for him. For example, for the time of transportation and storage, the handle can be pivoted into contact with the body, in which case the pipette requires a minimum of space.

Inside the body, there is a DC motor provided with a gearbox 9. By means of the operating switch 6 the volume can be passed to the motor 10 in any of the two directions, thereby rotating the motor in the desired direction. A gliding clutch 12 is attached to the output shaft 11 of the gearbox. The clutch 12 comprises a clutch flange 13 attached to the output shaft 11, an end flange 14 at the end of the shaft, as well as a cogwheel 15 and a spiral spring 16 fitted on the shaft between the flanges 13 and 14 so that the spring presses the cogwheel against the clutch flange. In this way, a clutch is formed which slips at a certain limit torque, preventing strains from impact loads from acting upon the motor and the gearbox.

The cogwheel 15 is fitted so that it displaces a toothed rack 17 in the body. At the bottom end, the movement of the toothed rack 17 is limited by a stationary limiter 18 and at the upper end by an adjustable limiter 19. The adjustable limiter is connected with a screw 20, on which a nut knob 21 is fitted as revolving in a hole in the body. Thus, by turning the knob 21, it is possible to displace the adjustable limiter 19 in the vertical direction.

The piston 22 is attached to the bottom end of the toothed rack 17 by means of a flange 23. Correspondingly, the cylinder 24 of the piston is attached to the body by means of a flange 25. The piston 22 and the cylinder 24 are attached to the pipette by pushing from the side, and they are removed by pressing the knob 26. In this way, it is easy to replace the cylinder part and to provide the pipette with a cylinder part operating within the desired volume range.

The fastening flange 25 of the cylinder is provided with a coded surface means, e.g., elevations 27 or, at corresponding locations, with plane portions or other configurations which, when the cylinder is being inserted into its position, press or do not press the selector switches 28 for volume range, which rest against the elevations. The elevations 27 form a code by means of which the volume display becomes automatically placed within the correct range for each cylinder.

The adjusting know 21 is provided with a cogwheel 29, which rotates the shaft of the volume detector 31 by means of a transmission cogwheel 30. The volume detector 31 may be, e.g., a pulse detector or a potentiometer. The detector 31 is connected to an electronics card 32, wherein the signal is converted in a known way to numerical form in a liquid crystal display 33 while taking the volume range set by the volume selector switches 28 into account.

The electronics card 32 is also connected to limit switches 34 and 35, which signal when the piston has moved to its extreme position, whereby the motor stops automatically. The limit switch may be a mechanical microswitch, e.g., a reed tube or a Hall element. When reed tubes or Hall elements are used, magnets 36 and 37 are fitted on the toothed rack accordingly. The upper limit switch 35 provided in the adjustable limiter is connected to the electronics card 32 by means of a flexible conductor 38.

The card 32 may also be connected with other adjustment or selection members, such as, for example, calibration trimmers 39, by means of which it is possible to calibrate the initial setting of the display.

Figure 2:
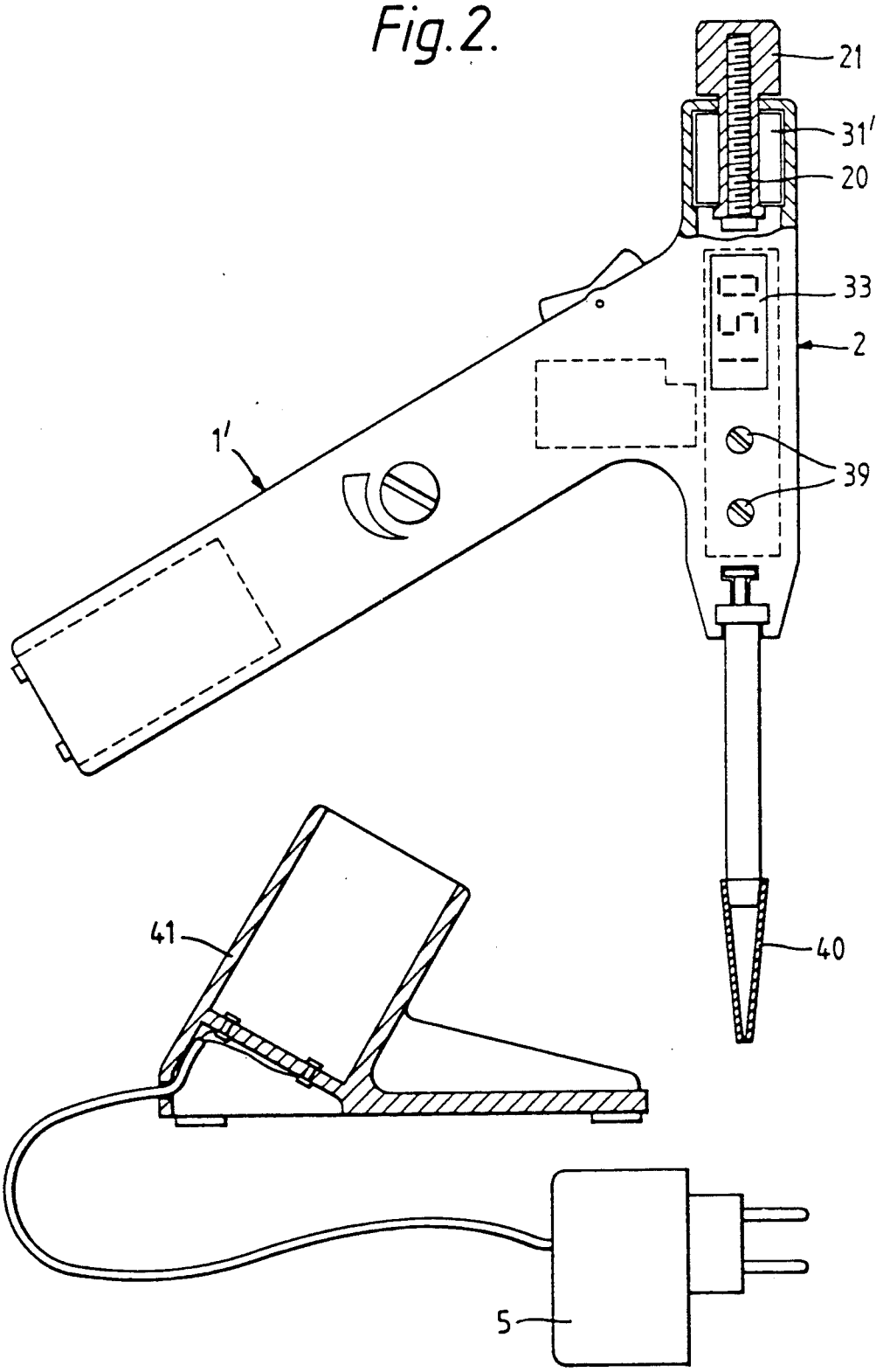
FIG. 2 is a partly sectional side view of a second embodiment together with a recharging stand.

In the pipette shown in FIG. 2, the handle 1' is attached to the body 2' stationarily. The volume detector 31' is fitted concentrically with the adjustment knob 21 and the screw 20, whereby the shaft of the knob also acts as the spindle of the detector. In the figure, the liquid crystal display 33, the calibration trimmers 39 and the tip vessel 40 are also shown. FIG. 2 further shows a pipette stand 41, to which the recharging device 5 is connected.

Figure 3:
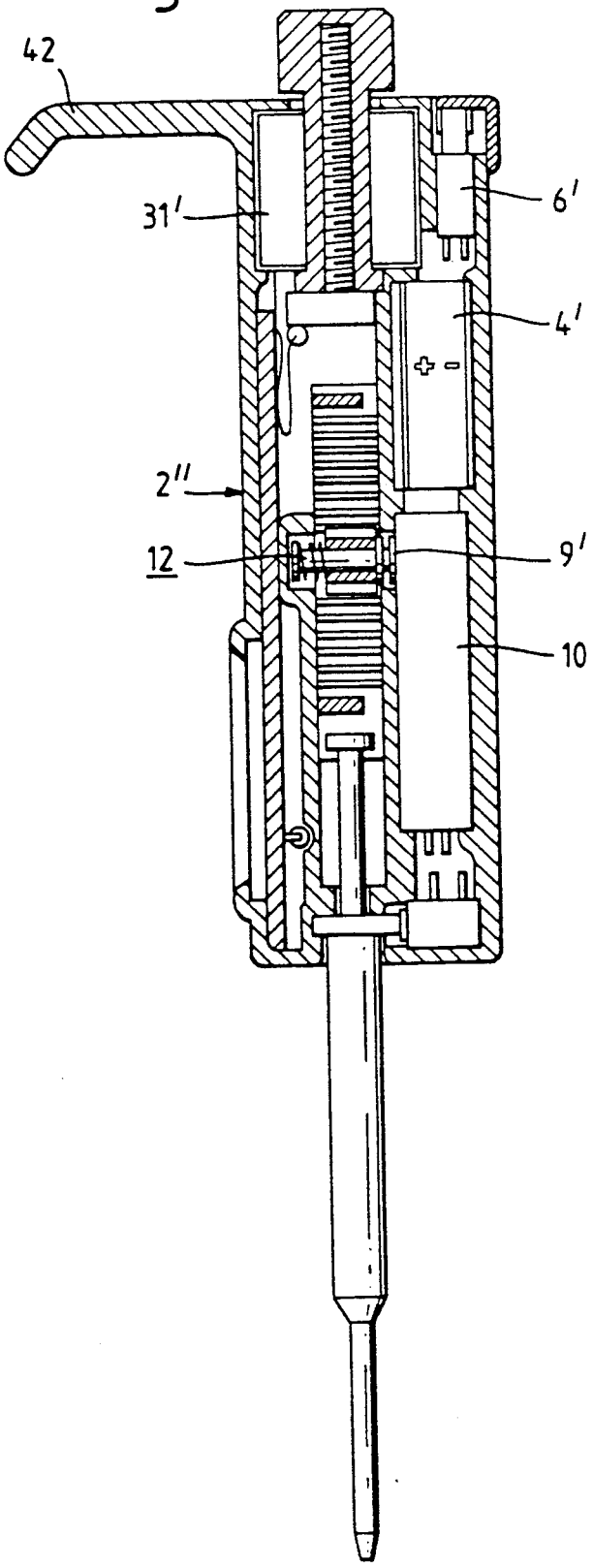
FIG. 3 shows a further embodiment as a sectional side view.

FIG. 3 shows an embodiment in which the body 2'' also acts as the handle and in whose interior all the necessary parts are fitted. The top portion of the body is provided with a projection 42 so as to permit a good grip.

In view of minimizing the space requirement, the motor 10 is connected to the clutch 12 by means of a right-angle bevel gear 9''. The batteries 4'' are placed above the motor, and the operating switch 6'' in the top portion of the body. The volume detector 31' is placed in the same way as in the embodiment shown in FIG. 2.

Figure 4:
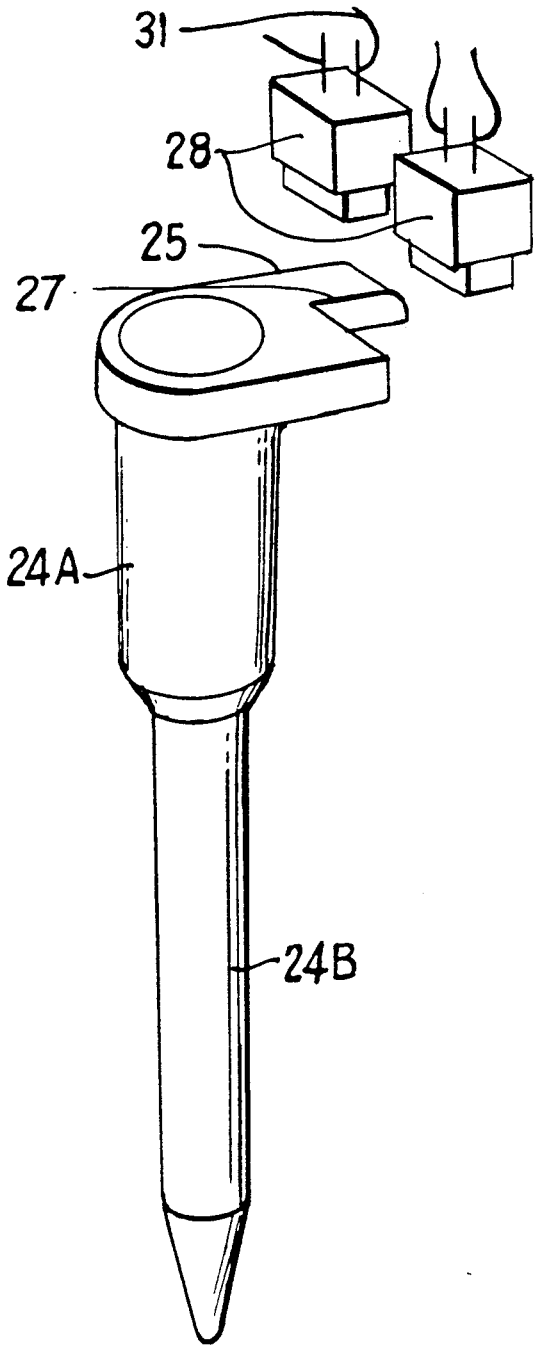
FIG. 4 is an embodiment in 3-dimensions showing flange 25 with a coded extension 27 for coacting with selector switches 28.
Figure 5:
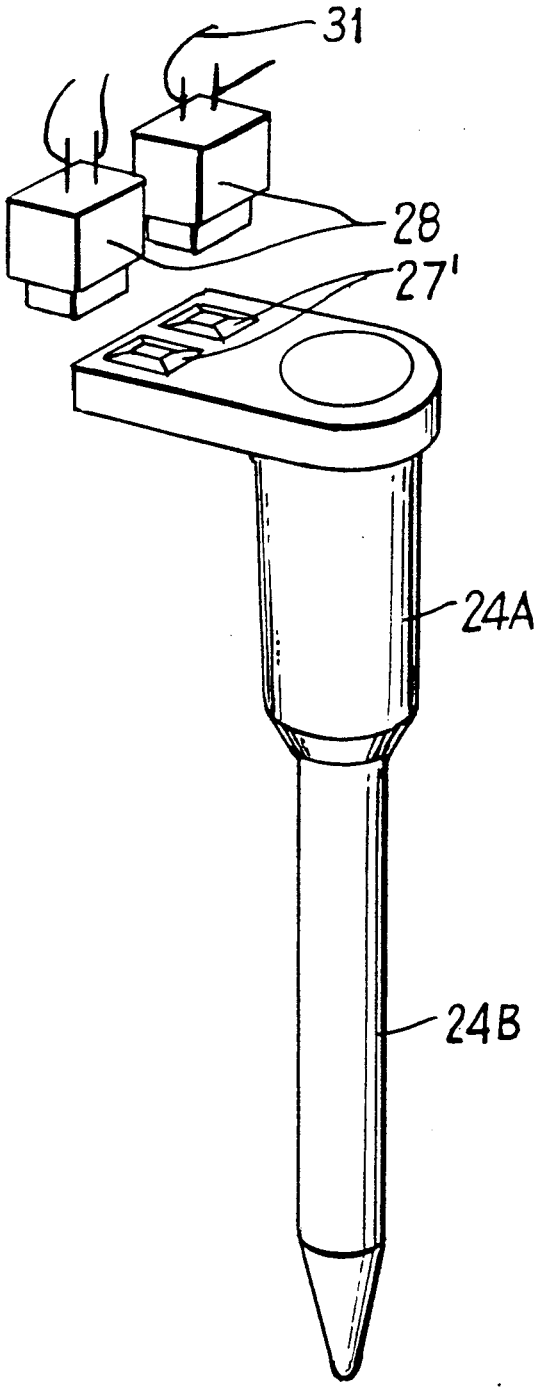
FIG. 5 is an embodiment in 3-dimensions showing coded surfaces 27', which may be in the forming notches, to coact with switches 28.

FIGS. 4 and 5 further exemplify embodiments of a flanged cylinder assembly similar to that shown for the flanged cylinder assembly (flange 1) of FIG. 1. As shown in FIG. 1, flange 27 is provided with coded surface means in the form of elevations to either actuate or not to actuate selector volume switches 28. In FIG. 4, however, flange 25 is provided with two coded extension means 27 to actuate switches 28 which are coupled to an electronic board. Two to four codes can be provided with this embodiment to correspond to four different values.

In FIG. 5 the coded surface means comprise notches 27' adapted to actuate the switches when necessary.

In either case, the code means may or may not actuate switch means 28.

The piston not shown is located within the cylinder identified by numerals 24A and 24B in which enlarged portion 24A is coextensive with reduced portion 24B. The piston has an enlarged portion corresponding to cylinder portion 24A and a reduced portion corresponding to cylinder portion 24B.

Thus, the coded surfaces which coact with switches 28 may comprise elevations, notches and other coding means.

Although the present invention has been described in conjunction with preferred embodiment, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. An electrically operated pipette comprising in combination a body member having lower and upper portions, a cylinder assembly and a piston disposed within said cylinder assembly extending downwardly from said body member, means removably coupling said cylinder assembly to said lower portion of said body member, a toothed rack movably mounted within said body member and capable of reciprocal longitudinal movement therein, one end of said rack being provided with means operatively coupling said end to said piston, said cylinder assembly having a flange at its upper end removably inserted into said lower portion of said body member, a first and second limiter disposed within said body member predetermined to limit the reciprocal movement of said rack, said second limiter being disposed at said lower portion of said body member, and said first limiter being disposed in said upper portion of said body member, said first limiter being adjustably positioned in said upper portion of said body member for respectively limiting the reciprocal movement of said rack in a first and second direction corresponding respectively to intake and discharge of fluid into and from said cylinder assembly, an electric motor located within said body member having an output shaft with a pinion cooperably and drivingly associated with said rack, said output shaft having a torque sensitive slip clutch cooperably associated therewith, an externally operable bidirectional switch cooperably associated with said body member for operating said motor, a threaded shaft joined to said first limiter and movable longitudinally for positioning or indexing said first limiter, said limiter-actuating shaft being oriented with its longitudinal axis parallel to the axis of said rack and passing through a means defining an opening in said body member in threading engagement with a threaded nut mounted as the upper portion of said body member for rotation in said means defining said opening, said nut being externally manipulable for threadedly adjusting the longitudinal position of said first limiter, signal transmitting means cooperably associated with said body member operatively coupled to said nut for providing a signal indicative of the position of said threaded shaft, and an externally readable volume indicating means mounted on an external surface of said body member coupled responsively to said transmitting means for indicating the volume intake setting of said pipette as determined by adjustment of said nut.

2. An electrically operated pipette as in claim 1, wherein said volume indicating means comprises a liquid display cooperably associated with an electronics card which receives signals from said signal transmitting means.

3. An electrically operated pipette as in claim 1, further comprising a depressible member cooperably associated with the lower portion of said member body and with said piston and removable cylinder assembly to enable the removal and replacement of this cylinder assembly.

4. An electrically operated pipette comprising in combination a body member having lower and upper portions, a flanged cylinder assembly and a piston disposed therein, means removably coupling said cylinder assembly via its flange to said lower portion of said body member, a toothed rack movably mounted within said body member and capable of reciprocal longitudinal movement therein, one end of said rack being provided with means operatively coupling said end to said piston, for longitudinally reciprocating said piston within said cylinder assembly, said cylinder assembly having a flange at its upper end removably inserted into said lower portion of said body member, a first and second limiter disposed within said body member predetermined to limit the reciprocal movement of said rack, said second limiter being disposed at said lower portion of said body member, and said first limiter being disposed in said upper portion of said body member, said first limiter being adjustably positioned in said upper portion of said body member for respectively limiting the reciprocal movement of said rack in a first and second direction corresponding respectively to intake and discharge of fluid into and from said cylinder assembly, an electric motor located within said body member having an output shaft with a pinion cooperably and drivingly associated with said rack, an externally operable bidirectional switch cooperably associated with said body member for operating said motor, signal transmitting means within said body member operatively coupled to said adjustable limiter for providing a signal indicative of the setting of said limiter, an externally readable volume indicating means mounted on an external surface of said body member coupled responsively to said transmitting means for indicating the volume setting of said pipette as predetermined by the adjustment of said adjustable limiter, and a depressible member cooperably associated with the lower portion of said body member with said piston and said flanged removable cylinder assembly to enable the removal and replacement of said assembly, the flange of said cylinder assembly being characterized by coded surface means which, through coaction with a selector switch determines the volume range such that the volume display is automatically set according to the volume range coded for each cylinder assembly.

5. An electrically operable pipette as in claim 4, wherein said coded surface means comprise elevations.

6. An electrically operable pipette as in claim 4, wherein said coded surface means comprise notches.

7. An electrically operable pipette as in claim 4, wherein a torque sensitive slip clutch is interposed between motor and its pinion in the coupling therebetween.

8. An electrically operated pipette comprising in combination a body member having lower and upper portions, a flanged cylinder assembly and a piston disposed therein, means removably coupling said cylinder assembly via its flange to said lower portion of said body member, a toothed rack movably mounted within said body member and capable of reciprocal longitudinal movement therein, one end of said rack being provided with means operatively coupling said end to said piston for longitudinally reciprocating said piston within said cylinder assembly, a first and second limiter disposed within said body member predetermined to limit the reciprocal movement of said rack, said second limiter being disposed at said lower portion of said body member, and said first limiter being disposed at said upper portion of said body member, said first limiter being adjustably positioned in said upper portion of said body member for respectively limiting the reciprocal movement of said rack in a first and second direction corresponding respectively to intake and discharge fluid into and from said flanged cylinder assembly, an electric motor having an output shaft with a pinion cooperably and drivingly associated with said rack, said output shaft having a torque sensitive slip clutch cooperably associated therewith, an externally operable bidirectional switch cooperably associated with said body member for operating said motor, signal transmitting means within said body member operatively coupled to said adjustably positioned limiter for providing a signal indicative of the setting of said adjustable limiter, and an externally readable volume indicating means mounted on an external surface of said body member coupled responsively to said transmitting means for indicating the volume setting of said pipette determined by adjustment of said adjustable limiter.

9. An electrically operated pipette as in claim 1, wherein said body member is provided with a projecting handle.

10. An electrically operated pipette as in claim 9, wherein said handle is attached to said body member by means of a vertically reticulated joint.

11. An electrically operated pipette as in claim 1, wherein said motor is provided with a source of voltage in the form of a battery or accumulator.

12. An electrically operated pipette as in claim 11, wherein said body member includes a housing part with an opening for receiving said battery or accumulator.

* * * * *